US008162744B2

(12) United States Patent
Takeda et al.

(10) Patent No.: US 8,162,744 B2
(45) Date of Patent: Apr. 24, 2012

(54) GAMING MACHINE EXECUTING EFFECTS USING SYMBOLS AND CONTROL METHOD THEREOF

(75) Inventors: Mitsuhiro Takeda, Tokyo (JP); Eri Dobashi, Tokyo (JP); Tomoyuki Hasegawa, Tokyo (JP); Takeshi Aoki, Tokyo (JP); Shintarou Okazawa, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 433 days.

(21) Appl. No.: 12/412,720

(22) Filed: Mar. 27, 2009

(65) Prior Publication Data

US 2010/0069141 A1 Mar. 18, 2010

Related U.S. Application Data

(60) Provisional application No. 61/046,392, filed on Apr. 18, 2008.

(51) Int. Cl.
*G06F 19/00* (2006.01)

(52) U.S. Cl. ..... 463/20

(58) Field of Classification Search ..... 463/20, 463/21

See application file for complete search history.

(56) References Cited

U.S. PATENT DOCUMENTS 6,261,178 B1 7/2001 Bennett
6,290,600 B1 * 9/2001 Glasson ..... 463/20
7,789,753 B2 * 9/2010 Marks et al. ..... 463/20

FOREIGN PATENT DOCUMENTS

AU 200119729 9/2001

* cited by examiner

*Primary Examiner* — William D Coleman
*Assistant Examiner* — Daniel Shook
(74) *Attorney, Agent, or Firm* — Sheppard, Mullin, Richter & Hampton LLP

(57) ABSTRACT

A gaming machine of the present invention performs an effect of rotating an image displayed in each display block having a second specific symbol rearranged therein in a direction so as to turn a display screen of a display over to the other side after scroll-displaying a specific character image to the display in a direction from one side of a symbol display region toward the opposite side, and also changing the second specific symbol rearranged in the each display block into a first specific symbol, when the first specific symbol and the second specific symbol have been rearranged in the symbol display region and also when it has been determined to display the specific character image; and offers an award in accordance with the number of first specific symbols arranged in the symbol display region as a result thereof.

6 Claims, 14 Drawing Sheets

Fig. 2

| Symbol | Number of rearranged symbols | | | |
|---|---|---|---|---|
| | 2 | 3 | 4 | 5 or more |
| A | 5 | 10 | 15 | m × (n-1) (※1) |
| 10 | 2 | 4 | 6 | |
| J | 3 | 6 | 9 | |
| Q | 30 | 60 | 90 | |
| K | 10 | 20 | 30 | |
| FISH 1a | 8 | 16 | 24 | |
| FISH 1A | 25 | 50 | 75 | |
| ・<br>・ | ・<br>・ | ・<br>・ | ・<br>・ | ・<br>・ |
| BONUS | Free game (※2) | | | |

※1 "m" represents amount of payout in the case where 2 symbols are rearranged
"n" represents the number of rearranged symbols ※2 When 3 or more symbols are rearranged, a free game is conducted

GAMING MACHINE EXECUTING EFFECTS USING SYMBOLS AND CONTROL METHOD THEREOF

CROSS-REFERENCE TO RELATED APPLICATIONS

This application claims benefit of priority based on U.S. Provisional Patent Application No. 61/046,392 filed on Apr. 18, 2008. The contents of this application are incorporated herein by reference in their entirety.

BACKGROUND OF THE INVENTION

1. Field of the Invention

The present invention relates to a gaming machine executing effects using symbols and a control method thereof.

2. Discussion of the Background

Conventionally, for example, as disclosed in U.S. Pat. No. 6,261,178, there is known a slot machine that rearranges a plurality of types of symbols, and pays out game media (coins or the like) in a prescribed amount based on a combination of the rearranged symbols.

Further, there exists a slot machine that executes a free game as a bonus game when a prescribed condition is established (e.g. specific symbols are rearranged in a slot machine game). The free game is a game that can be executed without spending game media. For example, Australian Patent Publication No. 1972901 discloses a slot machine that conducts a free game is as a side game when a prescribed condition (specific arrangement of symbols) is established.

However, in the conventional slot machines as described above, a symbol display mode at the time of symbol rearrangement is uniform. Namely, after symbols have been scroll-displayed to a display, the effect of stop-displaying the symbols to prescribed positions is repeated. Hence, there has been a problem in that the effect performed using symbols themselves at the time of rearrangement of the symbols is not novel, and the effect might thus feel monotonous.

The present invention was made in view of the foregoing problem, and has an object to provide a gaming machine capable of using symbols for an effect so as to produce a new advantage by the effect, and a control method of the gaming machine.

The contents of U.S. Pat. No. 6,261,178 and Australian Patent Publication No. 1972901 are incorporated herein by reference in their entirety.

SUMMARY OF THE INVENTION

A first aspect of the present invention provides a gaming machine having the following configuration.

Namely, the gaming machine comprises: a display capable of displaying an image; a memory which stores image data respectively showing a first specific symbol, a second specific symbol different from the first specific symbol, and other symbols different from both the first specific symbol and the second specific symbol; and a controller. The controller is programmed so as to execute the processing of (a) displaying to the display a rectangular symbol display region in which a plurality of display blocks are arranged in matrix form, (b) rearranging a symbol, shown by image data stored in the memory, in each display block of the symbol display region, (c) determining whether or not to display a specific character image relative to the symbol, to the display, (d) scroll-displaying the specific character image to the display in a direction from one side of the symbol display region toward the opposite side, performing an effect of rotating an image displayed in each display block having the second specific symbol rearranged therein around an imaginary central line of each display block as a rotational axis in a direction so as to turn a display screen of the display over to the other side, and changing the second specific symbol rearranged in the each display block into the first specific symbol, the above-mentioned processing being conducted when the first specific symbol and the second specific symbol have been rearranged in the symbol display region in the processing (b) and also when it has been determined in the processing (c) to display the specific character image, and (e) offering an award in accordance with the number of first specific symbols arranged in the symbol display region as a result of the processing (d).

According to the above gaming machine, when a first specific symbol (e.g. symbol showing large fish) and a second specific symbol (e.g. symbol showing small fish) have been rearranged to a display (e.g. liquid crystal display) and it has been determined to display a specific character image (e.g. image showing a fish shoal), the effect of rotating an image of the display block having the second specific symbol rearranged therein in a direction so as to turn a display screen over to the other side is performed after the specific character image has been scroll-displayed so as to move across a symbol display region, and also the second specific symbol rearranged in each display block is changed into the first specific symbol; and a payout is then offered in accordance with the number of first specific symbols arranged in the symbol display region as a result of the above change.

Namely, when the specific character image is displayed in a case where the first specific symbol and the second specific symbol have been rearranged, the image in the display block having the second specific symbol rearranged therein is rotated and the second specific symbol is changed into the first specific symbol. Therefore, performing the new effect using symbols can prevent the effect according to rearrangement of symbols from becoming monotonous.

Further, since the second specific symbol is changed into the first specific symbol when the specific character image is displayed, it is possible to make the player have an expectation for display of the specific character image.

Moreover, since the number of first specific symbols relative to offering of a payout changes based on whether or not the second specific symbol is simultaneously rearranged and whether or not the specific character image is displayed, variations can be added to the game, and hence it is possible to prevent the player from becoming bored and to have the player enjoy the game.

Further, the above-mentioned gaming machine desirably has the following configuration.

Namely, the controller is further programmed so as to execute the processing of (f) additionally displaying an image showing a sequential number in each display block where the first specific symbol has been arranged as a result of the processing (d).

According to the above gaming machine, since the display blocks each having the first specific symbol displayed therein are additionally provided with sequential numbers, the player can promptly and accurately grasp how many first specific symbols are displayed.

Further, since the sequential numbers are provided in a state where the first specific symbols arranged in the display blocks are kept as they are (i.e., the sequential numbers are additionally provided), the number of first specific symbols can be counted without impairing the effect advantage by the symbols.

A second aspect of the present invention provides the following.

Namely, The above-mentioned gaming machine comprises: a display capable of displaying an image; a memory which stores image data respectively showing a first specific symbol, a second specific symbol different from the first specific symbol, and other symbols different from both the first specific symbol and the second specific symbol; and a controller. The controller is programmed so as to execute the processing of (a) displaying to the display a symbol display region in which a plurality of display blocks are arranged in matrix form, (b) rearranging a symbol, shown by image data stored in the memory, in each display block of the symbol display region, (c) determining whether or not to display to the display a predictive image indicating a change from the second specific symbol into the first specific symbol, (d) changing a rearranged second specific symbol into the first specific symbol after displaying the predictive image to the display, when the first specific symbol and the second specific symbol have been rearranged in the symbol display region in the processing (b) and also when it has been determined in the processing (c) to display the predictive image, and (e) offering an award in accordance with the number of first specific symbols arranged in the symbol display region as a result of the processing (d).

According to the above gaming machine, when a first specific symbol (e.g. symbol showing large fish) and a second specific symbol (e.g. symbol showing small fish) are rearranged to a display (e.g. liquid crystal display) and it is determined to display a predictive image (e.g. image showing a fish shoal), the second specific symbol rearranged in each display block is changed into the first specific symbol after the predictive image has been displayed, and an award is then offered in accordance with the number of first specific symbols arranged in the symbol display region as a result of the above change.

Namely, when the predictive image is displayed in a case where the first specific symbol and the second specific symbol have been rearranged, the second specific symbol is changed into the first specific symbol. Therefore, performing the new effect using symbols can prevent the effect according to rearrangement of symbols from becoming monotonous.

Further, since the second specific symbol is changed into the first specific symbol when the predictive image is displayed, it is possible to make the player have an expectation for display of the predictive image.

Moreover, since the number of first specific symbols relative to offering of a payout changes based on whether or not the second specific symbol is simultaneously rearranged and whether or not the predictive image is displayed, variations can be added to the game, and hence it is possible to prevent the player from becoming bored and to have the player enjoy the game.

Further, the above-mentioned gaming machine desirably has the following configuration.

Namely, the controller is further programmed so as to execute the processing of (f) additionally displaying an image showing a sequential number in each display block where the first specific symbol has been arranged as a result of the processing (d).

According to the above gaming machine, since the display blocks each having the first specific symbol displayed therein are additionally provided with sequential numbers, the player can promptly and accurately grasp how many first specific symbols are displayed.

Further, since the sequential numbers are provided in a state where the first specific symbols are kept as they are (i.e., the sequential numbers are additionally provided), the number of first specific symbols can be counted without impairing the effect advantage by the symbols.

A third aspect of the present invention provides a control method of a gaming machine having the following configuration.

Namely, the control method of a gaming machine, the method comprises the steps of: (a) displaying a symbol display region in which a plurality of display blocks are arranged in matrix form, to a display capable of displaying an image, (b) rearranging in each display block of the symbol display region a symbol that is selected from a first specific symbol, a second specific symbol different from the first specific symbol, and other symbols different from both the first specific symbol and the second specific symbol, (c) determining whether or not to display to the display a predictive image indicating a change from the second specific symbol into the first specific symbol, (d) changing a rearranged second specific symbol into the first specific symbol after displaying the predictive image to the display, when the first specific symbol and the second specific symbol have been rearranged in the symbol display region in the step (b) and also when it has been determined in the step (c) to display the predictive image, and (e) offering an award in accordance with the number of first specific symbols arranged in the symbol display region as a result of the step (d).

According to the above control method of a gaming machine, when a first specific symbol (e.g. symbol showing large fish) and a second specific symbol (e.g. symbol showing small fish) are rearranged to a display (e.g. liquid crystal display) and it is determined to display a predictive image (e.g. image showing a fish shoal), the second specific symbol rearranged in each display block is changed into the first specific symbol after the predictive image has been displayed, and an award is then offered in accordance with the number of first specific symbols arranged in the symbol display region as a result of the above change.

Namely, when the predictive image is displayed in a case where the first specific symbol and the second specific symbol have been rearranged, the second specific symbol is changed into the first specific symbol. Therefore, performing the new effect using symbols can prevent the effect according to rearrangement of symbols from becoming monotonous.

Further, since the second specific symbol is changed into the first specific symbol when the predictive image is displayed, it is possible to make the player have an expectation for display of the predictive image.

Moreover, since the number of first specific symbols relative to offering of an award changes based on whether or not the second specific symbol is simultaneously rearranged and whether or not the predictive image is displayed, variations can be added to the game, and hence it is possible to prevent the player from becoming bored and to have the player enjoy the game.

Further, the above-mentioned control method of a gaming machine desirably has the following configuration.

Namely, the method further includes the step of (f) additionally displaying an image showing a sequential number in each display block where the first specific symbol has been arranged as a result of the step (d).

According to the above control method of a gaming machine, since the display blocks having the first specific symbol displayed therein are additionally provided with sequential numbers, the player can promptly and accurately grasp how many first specific symbols are displayed.

Further, since the sequential numbers are provided in a state where the first specific symbols are kept as they are (i.e., the sequential numbers are additionally provided), the number of first specific symbols can be counted without impairing the effect advantage by the symbols.

BRIEF DESCRIPTION OF THE DRAWINGS

FIG. 2 is a view showing a relation between the number of rearranged symbols and the individual amount of payout.

DESCRIPTION OF THE EMBODIMENTS

An embodiment of the present invention is described based on drawings.

First, images displayed to a lower image display panel provided in a slot machine according to one embodiment of the present invention are described.

FIGS. 1A to 1E are views each showing an example of images displayed to the lower image display panel.

In the present embodiment, a prize is determined based on how many symbols of the same type are displayed in a symbol display region 1 of a lower image display panel 16 in a slot machine 10 (see FIG. 3) (see FIG. 2).

When over three "BONUS" symbols are displayed, a bonus game is executed. In the present embodiment, the bonus game is a free game (game in which games can be played for a prescribed number of times without betting coins). In FIG. 1A to FIG. 1E, images displayed to the lower image display panel 16 in the bonus game are described.

Figure 1A:
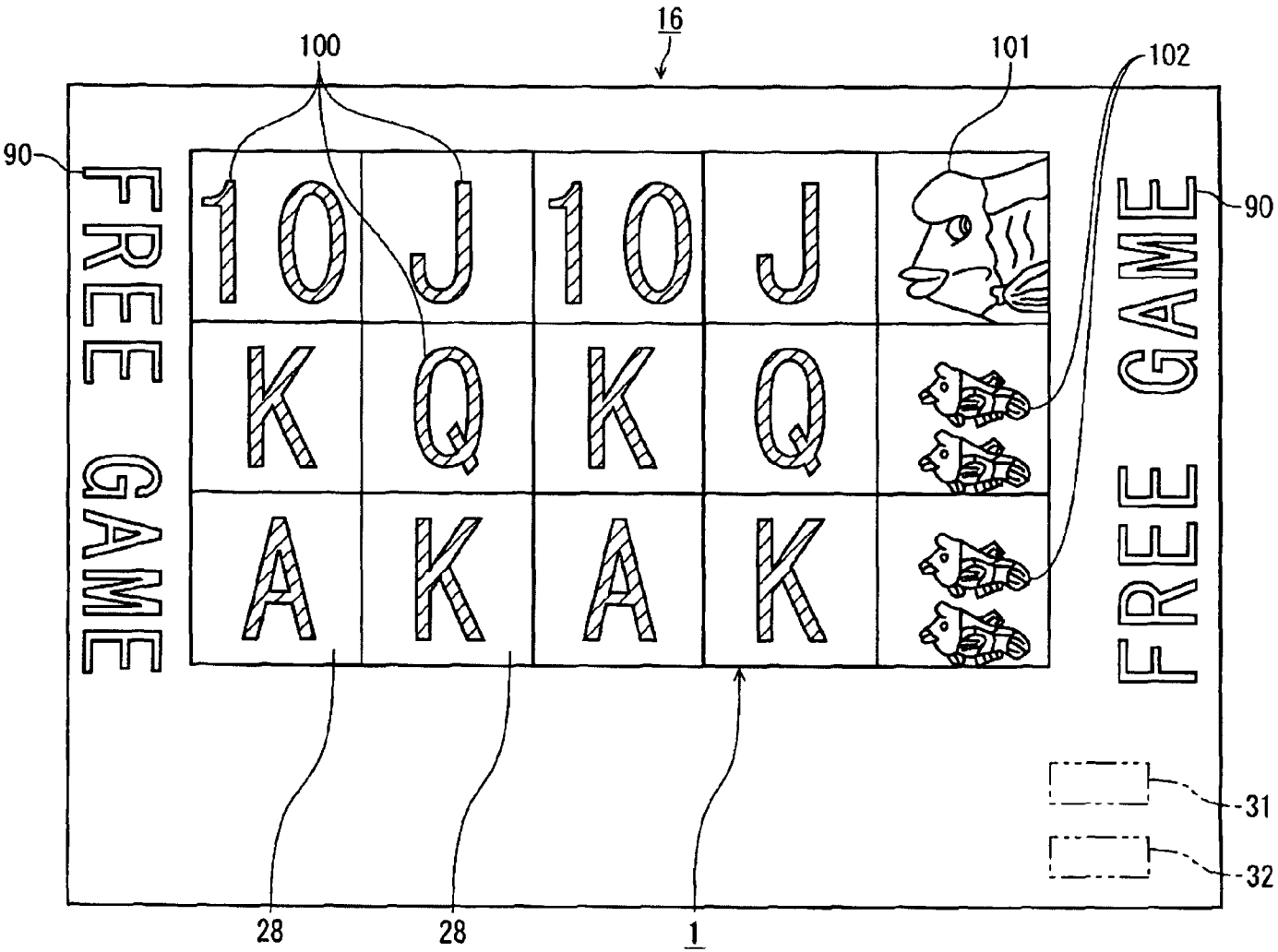
FIG. 1A is a view showing an example of images displayed to a lower image display panel.

FIG. 1A is an example of images in a case where symbols are rearranged in a certain game during the bonus game (free game).

To each side of the lower image display panel 16, there is displayed an image 90 showing that the free game is in execution.

Further, symbols 100 showing letters and figures, an adult fish symbol 101 showing big fish, and young fish symbols 102 showing small fish are displayed in respective display blocks 28 forming the symbol display region 1. As shown in FIG. 1A, the adult fish symbol 101 is displayed in the display block 28 at the upper right corner portion of the symbol display region 1, and the young fish symbols 102 are displayed in the two display blocks 28 under the adult fish symbol 101. The adult fish symbol 101 corresponds to the first specific symbol in the present invention, and the young fish symbol 102 corresponds to the second specific symbol in the present invention.

Moreover, a number-of-credits display portion 31 and a number-of-payouts display portion 32 are set in the lower right portion of the lower image display panel 16. In the number-of-credits display portion 31, the number of credited coins is displayed by an image. In the number-of-payouts display portion 32, the number of coins to be paid out is displayed by an image.

Figure 1B:
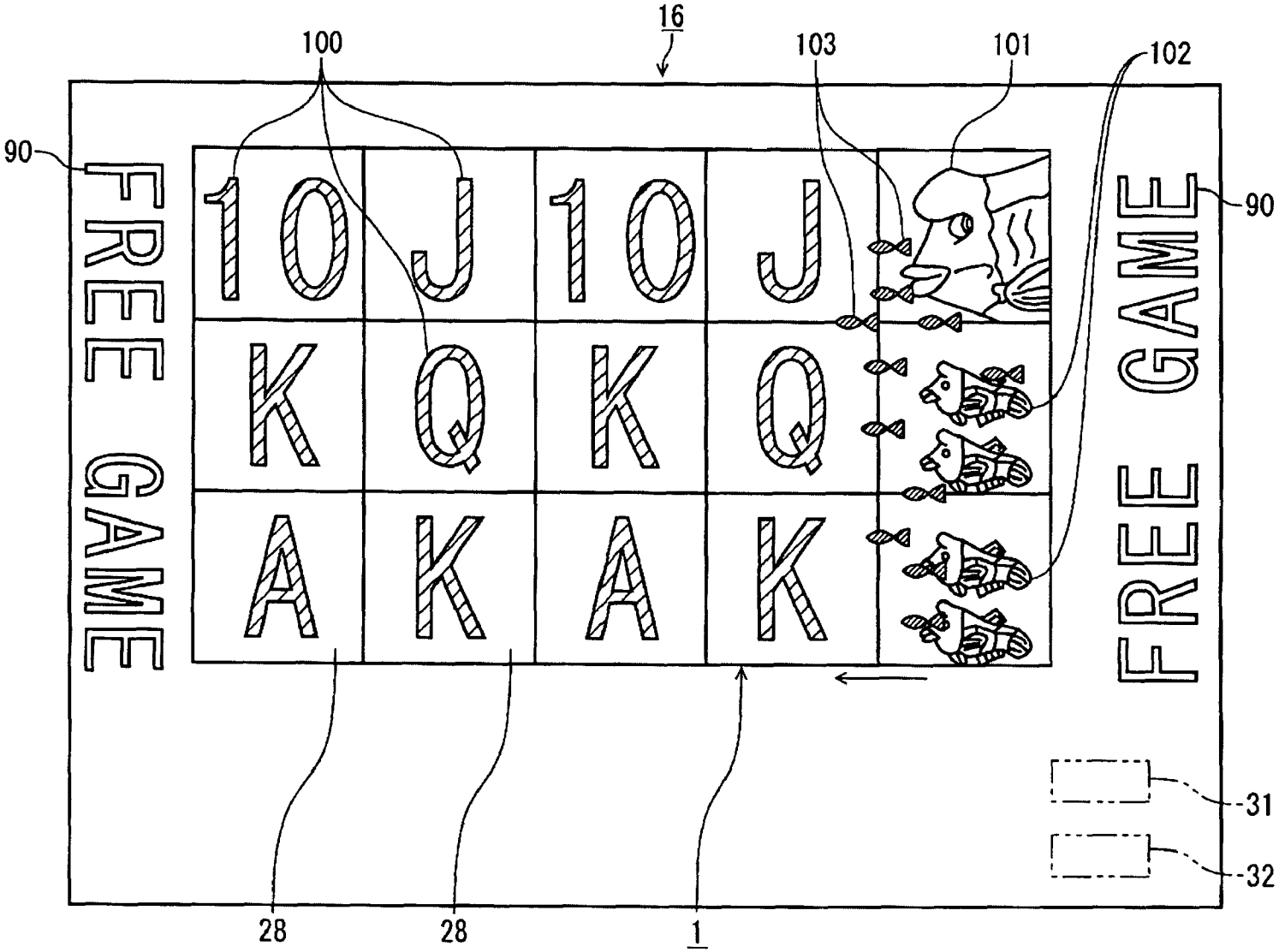
FIG. 1B is a view showing an example of images displayed to the lower image display panel.

As shown in FIG. 1A, when the adult fish symbol 101 and the young fish symbols 102 are simultaneously rearranged, and also when it is determined to display images indicating a change from the young fish symbols 102 into the adult fish symbol 101, a fish shoal image 103 showing a fish shoal is scroll-displayed in a direction from the right-hand side of the symbol display region 1 toward the side facing thereto (direction of an arrow in the figure), as shown in FIG. 1B.

Figure 1C:
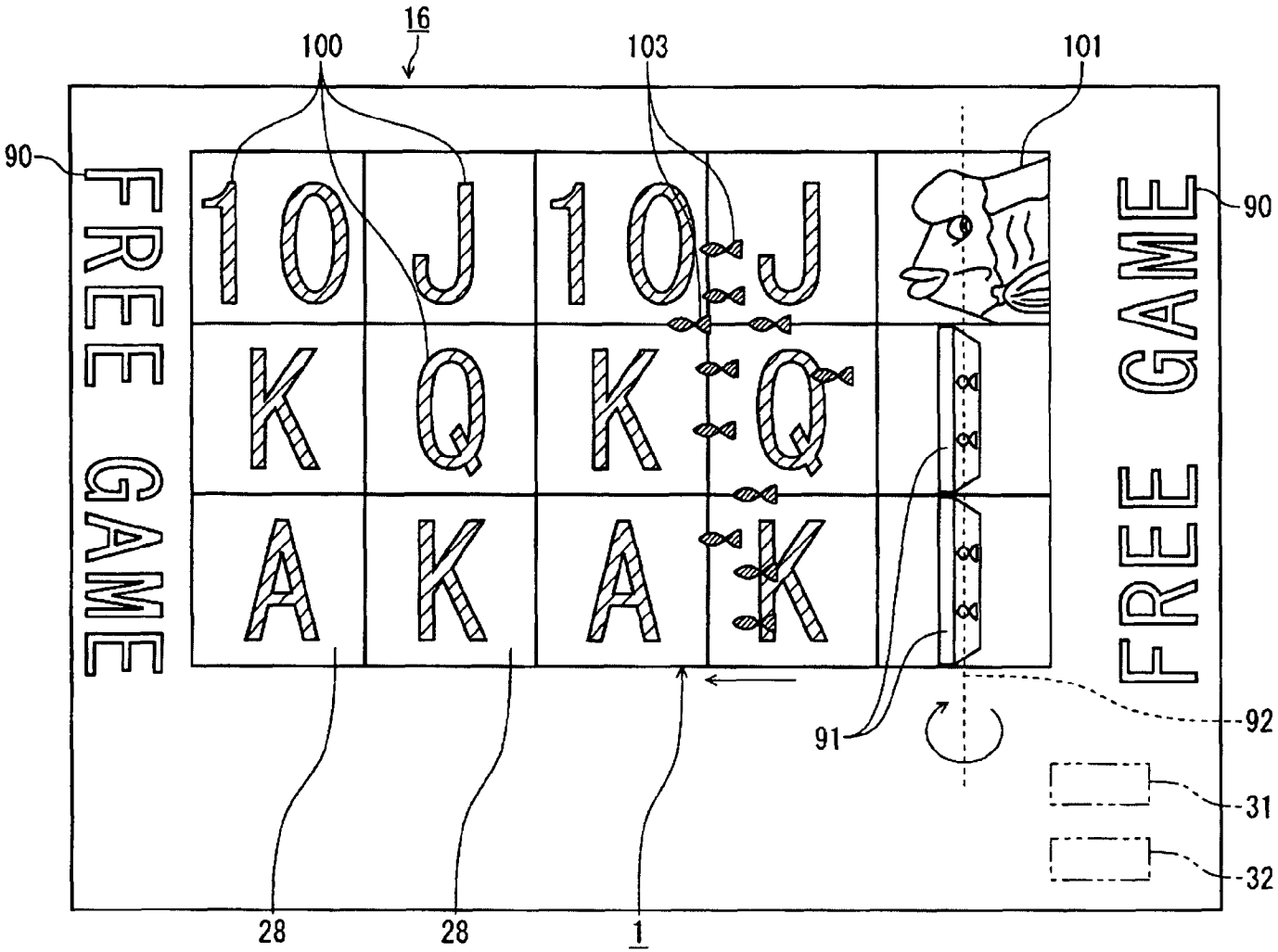
FIG. 1C is a view showing an example of images displayed to the lower image display panel.

When the fish shoal image 103 is scroll-displayed and then passes by, as shown in FIG. 1C, rotational display block images 91 showing rotating display blocks are displayed in the display blocks 28 where the young fish symbols 102 have been displayed, and an effect is executed as if images in the display blocks 28 are rotated in a direction to turn the display screen over to the other side. At this time, the rotational display block image 91 is displayed as if rotating around an imaginary central line 92, which is indicated by a broken line in the figure, as a rotational axis.

The imaginary central line 92 is a line showing an imaginary central line of each display block 28, and is not displayed in the actual lower image display panel 16.

Figure 1D:
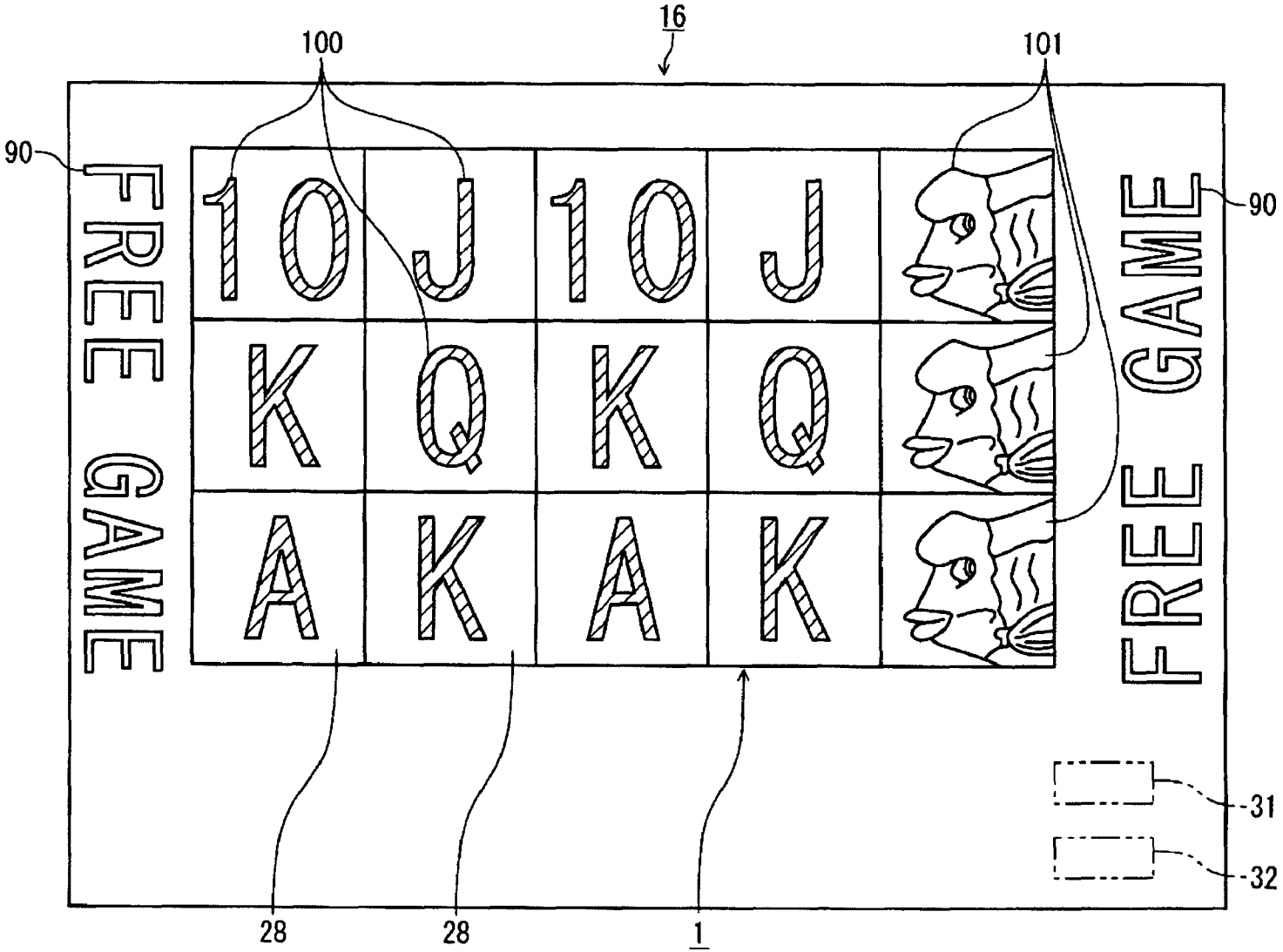
FIG. 1D is a view showing an example of images displayed to the lower image display panel.

After the rotational effect by the rotational display block image 91 is executed for a prescribed period of time, in the display blocks 28 each having the young fish symbol 102 displayed therein, the adult fish symbols 101 are displayed as shown in FIG. 1D.

Figure 1E:
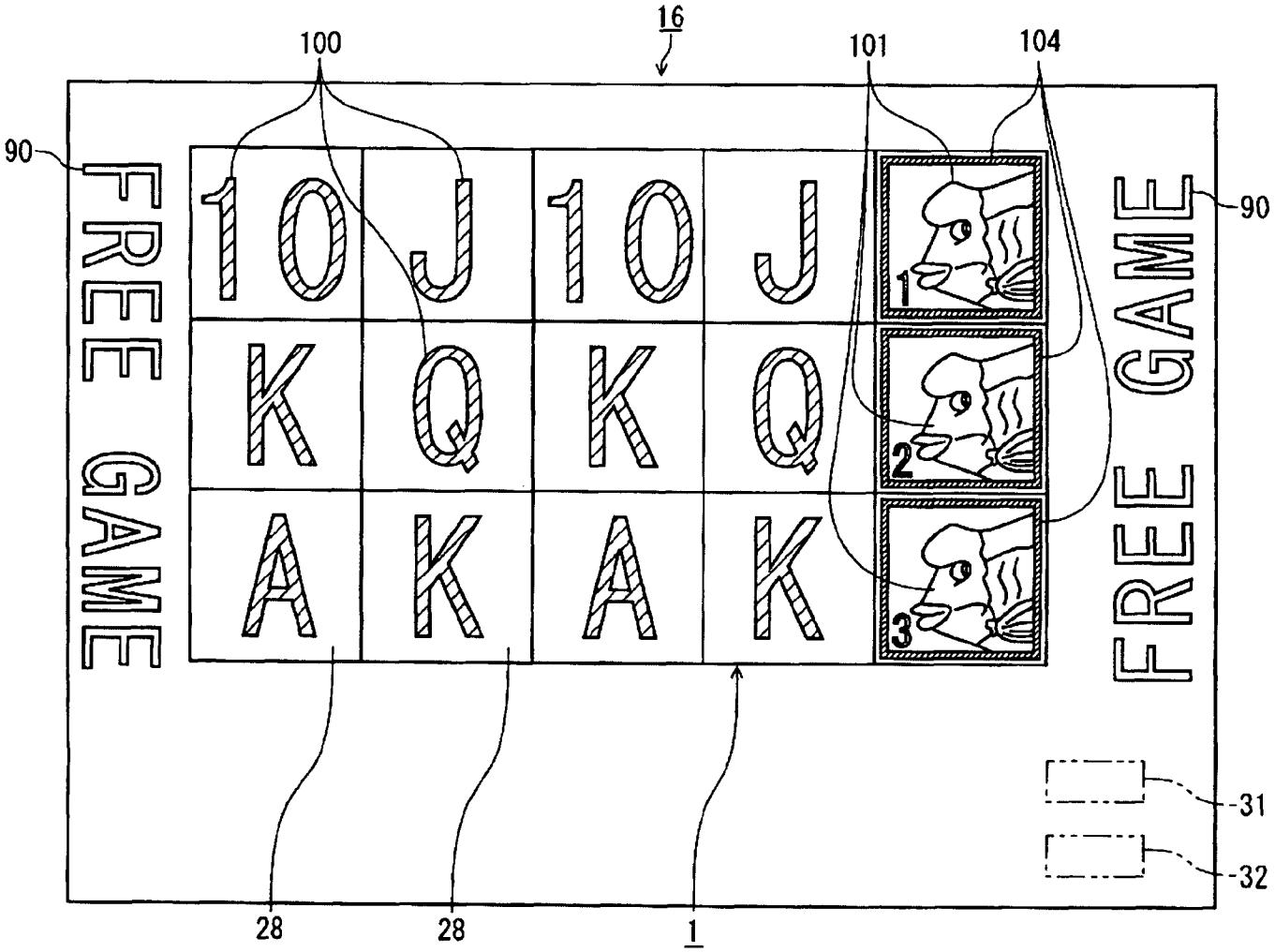
FIG. 1E is a view showing an example of images displayed to the lower image display panel.

When the change in symbol (change from the young fish symbol 102 into the adult fish symbol 101) is completed, symbol count images 104 including images of sequential numbers are additionally displayed in the display blocks 28 where the adult fish symbols 101 are displayed, as shown in FIG. 1E. The symbol count images 104 are displayed in order of the sequential numbers included in these images. In the example of FIG. 1E, the symbol count images 104 are displayed in order of the symbol count image 104 including "1", the symbol count image 104 including "2" and the symbol count image 104 including "3".

When counting of the symbols is completed, a payout is offered in accordance with the number of displayed adult fish symbols 101.

As just described, as the whole of FIG. 1A to FIG. 1E, when the adult fish symbol 101 and the young fish symbols 102 are simultaneously rearranged and also the fish shoal image 103 is displayed so as to move across the symbol display region 1, the young fish symbols 102 are rotated and changed into the adult fish symbols 101, followed by execution of the effect of counting the adult fish symbols 101.

Next, a method for calculating an amount of payout is displayed.

FIG. 2 is a view showing relations between the numbers of rearranged symbols and the amounts of payout.

It is to be noted that the amounts of payout shown in the figure are ones in a case where the number of bets is 1.

As shown in FIG. 2, the amounts of payout are set in association with the types and the numbers of rearranged symbols. FIG. 2 shows, as examples of symbols, "A", "10", "J", "Q", "K", "FISH 1a" and "FISH 1A". Among these symbols, "FISH 1a" corresponds to the young fish symbol 102, and "FISH 1A" corresponds to the adult fish symbol 101.

In the present embodiment, all symbols are so-called scatter symbols. It should be noted that the scatter symbols are symbols the displayed number of which the determination of a prize is based on.

For example, as shown in FIG. 1E, when three adult fish symbols 101 ("FISH 1A") are rearranged in the lower image display panel 16, the amount of payout is an amount corresponding to 50 coins. Further, for example, when eight adult fish symbols 101 ("FISH 1A") are rearranged, an amount of payout is an amount corresponding to 175 coins, as obtained by "25×(8−1)=175".

Next, the configuration of the slot machine 10 according to the present embodiment will be described.

Figure 3:
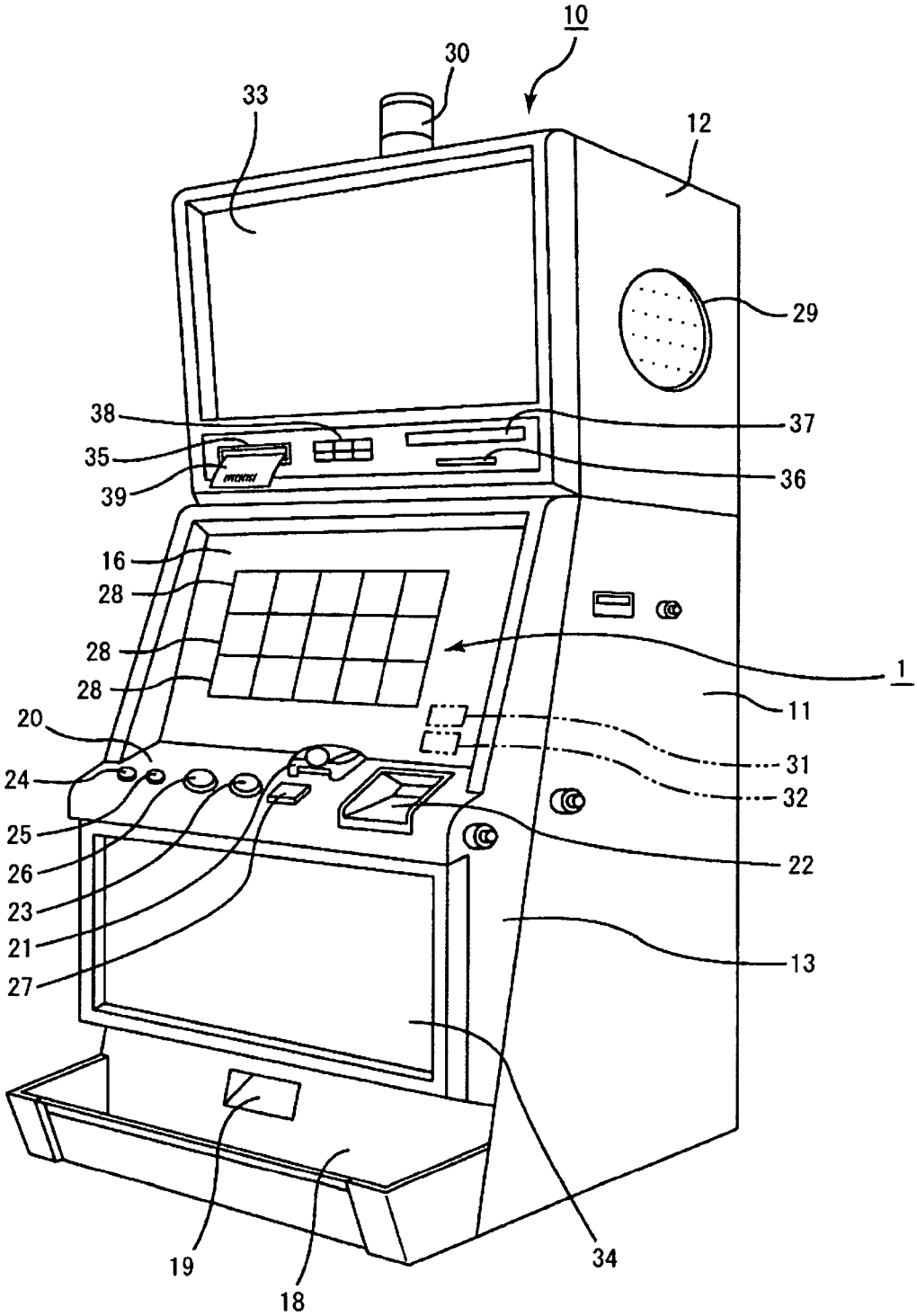
FIG. 3 is a perspective view showing an external view of a slot machine according to the present embodiment.

FIG. 3 is a perspective view showing an external view of a slot machine according to the present invention.

In the slot machine 10, a coin, a bill, or electronic valuable information corresponding to those is used as a game medium. However, the game medium in the present invention is not particularly limited thereto; examples of the game medium include a medal, a token, electronic money, and a ticket. It should be noted that the above-mentioned ticket is not particularly limited, and examples thereof may include a ticket with a barcode as described later.

The slot machine 10 is equipped with a cabinet 11, a top box 12 installed on the upper side of the cabinet 11, and a main door 13 provided at the front face of the cabinet 11.

The lower image display panel 16 as a display is provided on the main door 13. The lower image display panel 16 has a transparent liquid crystal panel to which the symbol display region 1 consisting of 15 (=5×3) display blocks 28 is displayed. To each of the display blocks 28, one symbol is to be displayed.

Further, a number-of-credits display portion 31 and a number-of-payouts display portion 32 are arranged in the lower image display panel 16. The number of credited coins is displayed, as an image, to the number-of-credits display portion 31. The number of coins to be paid out is displayed, as an image, to the number-of-payouts display portion 32.

Moreover, at the front face of the lower image display panel 16, although not shown, the touch panel 69 is provided so that a player can operate the touch panel 69 to input various types of commands.

Below the lower image display panel 16, there are provided a control panel 20 consisting of a plurality of buttons 23 to 27 with each of which the player inputs a command according to the progress of a game, a coin receiving slot 21 which accepts a coin into the cabinet 11, and a bill validator 22.

The control panel 20 is provided with the spin button 23, a change button 24, a CASHOUT button 25, a 1-BET button 26, and a maximum BET button 27. The spin button 23 is used for inputting a command to start scrolling of symbols. The change button 24 is used for making a request of staff in the recreation facility for exchange. The CASHOUT button is used for inputting a command to pay out credited coins to a coin tray 18.

The 1-BET button 26 is used for inputting a command to bet one coin on a game out of credited coins. The maximum BET button 27 is used for inputting a command to bet a maximum number of coins that can be bet on one game (50 coins in the present embodiment) out of credited coins.

The bill validator 22 not only discriminates a regular bill from a false bill, but also accepts the regular bill into the cabinet 11. It should be noted that the bill validator 22 may be configured so as to be able to read a later-described ticket 39 with a barcode. At the lower front face of the main door 13, namely below the control panel 20, a belly glass 34 having a character or the like of the slot machine 10 drawn thereon is provided.

At the front face of the top box 12, an upper image display panel 33 is provided. The upper image display panel 33 has a liquid crystal panel to display, for example, an image showing introduction of the game contents and explanation of a rule of the game.

Further, a speaker 29 is installed in the top box 12. Below the upper image display panel 33, there are provided a ticket printer 35, a card reader 36, a data display 37, and a key pad 38. The ticket printer 35 is used for printing on a ticket a barcode as coded data of the number of credits, date, an identification number of the slot machine 10, and the like, and outputs the ticket as a ticket 39 with a barcode. The player can make another slot machine 10 read the ticket 39 with a barcode so as to play games thereon, or exchange the ticket 39 with a barcode with a bill or the like at a predetermined place in the recreation facility (for example, a cashier in a casino).

The card reader 36 reads data from a smart card and writes data into the smart card. The smart card is owned by the player, and for example, data for identifying the player, data relating to a history of games played by the player are stored therein. Data corresponding to a coin, a bill, or a credit may be stored into the smart card. Further, in place of a smart card, a magnetic stripe card may be adopted. The data display 37 is comprised of a fluorescent display or the like, and displays, for example, data read by the card reader 36 and data inputted by the player via the key pad 38. The key pad 38 is used for inputting a command and data relating to the issue of a ticket and the like.

Figure 4:
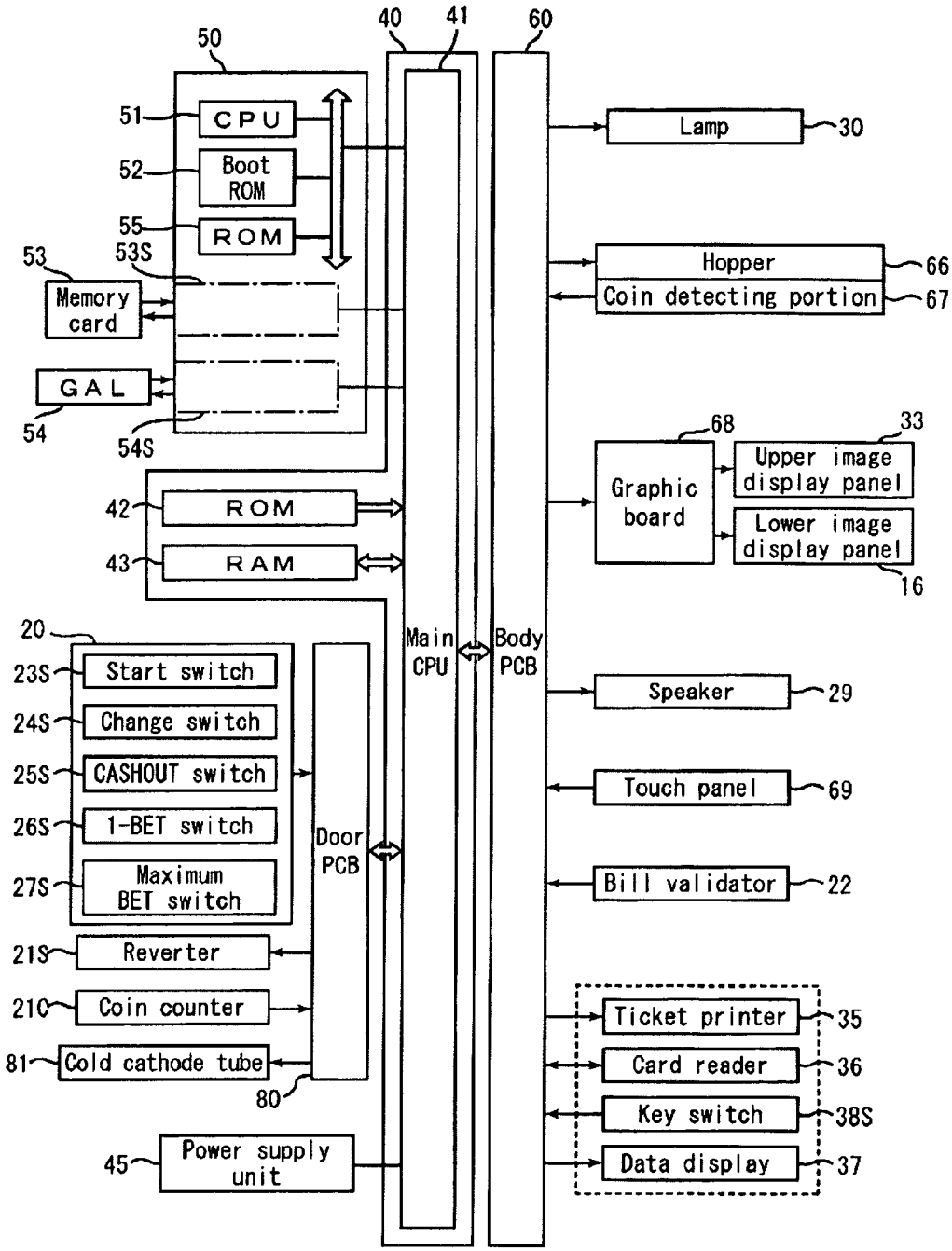
FIG. 4 is a block diagram showing an internal configuration of the slot machine shown in FIG. 3.

FIG. 4 is a block diagram showing an internal configuration of the slot machine shown in FIG. 3.

A gaming board 50 includes: a CPU (Central Processing Unit) 51, a ROM 55 and a boot ROM 52 that are interconnected to one another by an internal bus; a card slot 53S corresponding to a memory card 53; and an IC socket 54S corresponding to a GAL (Generic Array Logic) 54.

The memory card 53 is comprised of a nonvolatile memory such as CompactFlash (registered trademark) and stores game programs. The game programs include a symbol determination program. The symbol determination program is for determining symbols (code Nos. corresponding to the symbols) to be rearranged to the display blocks 28.

Further, the card slot 53S is configured to allow the memory card 53 to be inserted thereinto or ejected therefrom and is connected to a mother board 40 by an IDE bus. Accordingly, the types and the contents of games played in the slot machine 10 can be changed by ejecting the memory card 53 from the card slot 53S, writing another game program into the memory card 53, and then inserting the memory card 53 into the card slot 53S. The game programs include programs relating to progresses of games. Further, the game programs include image data and sound data that are outputted during games.

The CPU 51, the ROM 55, and the boot ROM 52 interconnected to one another by the internal bus are connected to the mother board 40 by a PCI bus. The PCI bus not only conducts signal transmission between the mother board 40 and the gaming board 50, but also supplies electric power to the gaining board 50 from the mother board 40.

The mother board 40 is comprised of a general-purpose mother board (a printed circuit board on which basic components of a personal computer are mounted), and is provided with the main CPU 41, a ROM (Read Only Memory) 42, and a RAM (Random Access Memory) 43. The mother board 40 corresponds to the controller in the present invention.

The ROM 42 is comprised of a memory device such as flash memory, and stores programs such as BIOS (Basic Input/Output System) executed by the main CPU 41, and permanent data. When BIOS is executed by the main CPU 41, not only is processing for initializing predetermined peripheral devices conducted, but also processing for loading the game program stored in the memory card 53 is conducted through the gaming board 50. It should be noted that, in the present invention, the ROM 42 may or may not be a data rewritable one.

The RAM 43 stores data and programs to be used at the time of operation of the main CPU 41. Further, the RAM 43 is capable of storing game programs.

Further, image data showing a variety of symbols displayed in the display blocks 28 and a variety of effect image data are stored into the RAM 43. The variety of symbols include symbols showing letters and figures, adult fish symbols, and young fish symbols. There are a plurality of kinds of adult fish symbols and young fish symbols, and an adult fish symbol and a young fish symbol of the same kind of fish are associated to each other. When the adult fish symbol and the young fish symbol of the same kind of fish are simultaneously displayed in the symbol display region 1 and also when the fish shoal image is displayed, the young fish symbol is changed into the adult fish symbol of the same kind of fish.

Moreover, the RAM 43 stores data such as the number of credits, and the numbers of inserted coins and payouts per game.

The RAM 43 corresponds to the memory in the present invention.

The mother board 40 is connected with a later-described body PCB (Printed Circuit Board) 60 and a door PCB 80 through respective USBs. Further, a power supply unit 45 is connected to the mother board 40.

The body PCB 60 and the door PCB 80 are connected with instruments and devices that generate an input signal to be inputted to the main CPU 41, and equipment and devices the operations of which are controlled by a control signal outputted from the main CPU 41. The main CPU 41 conducts a game program stored in the RAM 43 based on the input signal inputted in the main CPU 41, thereby conducting predetermined arithmetic processing, storing the result thereof into the RAM 43, and transmitting a control signal to the respective instruments and devices as processing for controlling the respective instruments and devices.

The body PCB 60 is connected with a lamp 30, the hopper 66, a coin detecting portion 67, a graphic board 68, the speaker 29, the touch panel 69, the bill validator 22, the ticket printer 35, the card reader 36, a key switch 38S, and the data display 37. The lamp 30 is lighted in a predetermined pattern based on a control signal outputted from the main CPU 41.

The hopper 66 is installed inside the cabinet 11, and pays out a predetermined number of coins from a coin payout exit 19 to a coin tray 18, based on a control signal outputted from the main CPU 41. The coin detecting portion 67 is installed inside the coin payout exit 19, and outputs an input signal to the main CPU 41, when detecting a payout of a predetermined number of coins from the coin payout exit 19.

The graphic board 68 controls image display in the upper image display panel 33 and the lower image display panel 16, based on a control signal outputted from the main CPU 41. In each of the display blocks 28 in the lower image display panel 16, there are displayed a background color determined by a random number selection, and a symbol being scrolled or stopped. The number of credits stored in the RAM 43 is displayed to the number-of-credits display portion 31 in the lower image display panel 16. Further, the number of coin-outs is displayed to the number-of-payouts display portion 32 in the lower image display panel 16.

The graphic board 68 is provided with a VDP (Video Display Processor) for generating image data based on a control signal outputted from the main CPU 41, a video RAM for temporarily storing image data generated by the VDP, and the like. Here, the image data used in generation of the image data by the VDP is included in the game program read from the memory card 53 and stored into the RAM 43.

The bill validator 22 not only discriminates a regular bill from a false bill, but also accepts the regular bill in the cabinet 11. Upon acceptance of the regular bill, the bill validator 22 outputs an input signal to the main CPU 41, based on the face amount of the bill. The main CPU 41 stores into the RAM 43 the number of credits according to the face amount of the bill transmitted with the input signal.

The ticket printer 35 prints on a ticket a barcode formed by encoding data of the number of credits stored in the RAM 43, date, an identification number of the slot machine 10 and the like based on a control signal outputted from the main CPU 41, and outputs the ticket as a ticket 39 with a barcode. The card reader 36 reads data from a smart card and transmits the data to the main CPU 41, and writes data into the smart card based on a control signal from the main CPU 41. The key switch 38S is provided on the key pad 38, and outputs a predetermined input signal to the main CPU 41 when the key pad 38 is operated by the player. The data display 37 displays data read by the card reader 36 and data inputted by the player via the key pad 38, based on a control signal outputted from the main CPU 41.

The door PCB 80 is connected with a control panel 20, a reverter 21S, a coin counter 21C, and a cold cathode tube 81. The control panel 20 is provided with the start switch 23S corresponding to the spin button 23, a change switch 24S corresponding to the change button 24, a CASHOUT switch 25S corresponding to the CASHOUT button 25, a 1-BET switch 26S corresponding to the 1-BET button 26, and a maximum BET switch 27S corresponding to the maximum BET button 27. The respective switches 23S to 27S output an input signal to the main CPU 41 when each of the buttons 23 to 27 corresponding thereto is operated by the player.

The coin counter 21C is provided inside the coin receiving slot 21 so as to discriminate a regular coin from a false coin inserted into the coin receiving slot 21 by the player. A coin other than the regular coin is discharged from the coin payout exit 19. Further, the coin counter 21C outputs an input signal to the main CPU 41, upon detection of a regular coin.

The reverter 21S operates based on a control signal outputted from the main CPU 41, and distributes the coin recognized by the coin counter 21C as a regular coin into a cashbox (not shown) or the hopper 66 that are installed inside the slot machine 10. More specifically, the reverter 21S distributes the regular coin into the cashbox when the hopper 66 is filled with coins; on the other hand, the reverter 21S distributes the regular coin into the hopper 66 when the hopper 66 is not filled with coins. The cold cathode tube 81 functions as a back light installed on the rear face side of the lower image display panel 16 and the upper image display panel 33, and is lighted based on a control signal outputted from the main CPU 41.

Next, processing performed in the slot machine 10 is described.

The main CPU 41 reads and executes a game program, to proceed with a game.

Figure 5:
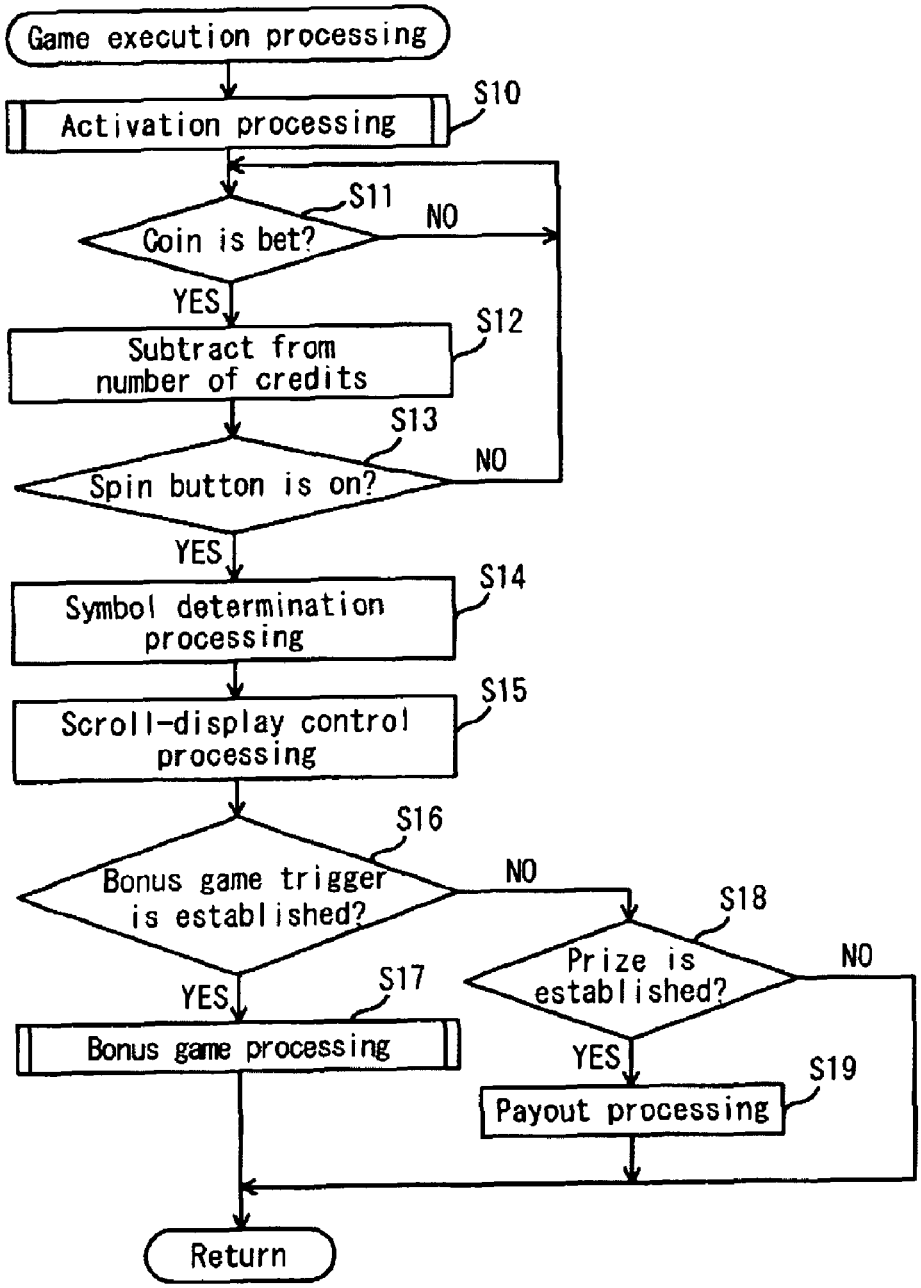
FIG. 5 is a flowchart showing a subroutine of game execution processing.

FIG. 5 is a flowchart showing a subroutine of game execution processing.

In the game execution processing, first, the main CPU 41 included in the slot machine 10 performs activation processing executed by the mother board 40 and the gaming board 50 (step S10). The activation processing is detailed later using FIG. 6 to FIG. 8.

Next, the main CPU 41 determines whether or not coins have been betted (step S11). In this processing, the main CPU 41 determines whether or not it has received an input signal that is outputted from the 1-BET switch 26S when the 1-BET button 26 is operated or an input signal that is outputted from the maximum BET switch 27S when the maximum BET button 27 is operated. When determining that coins have not been betted, the main CPU 41 returns the processing to step S11.

On the other hand, when determining in step S11 that coins have been betted, the main CPU 41 performs processing of making a subtraction from the number of credits stored in the RAM 43 in accordance with the number of betted coins (step S12). It is to be noted that, when the number of betted coins is larger than the number of credits stored in the RAM 43, the main CPU 41 returns the processing to step S11 without performing the processing of making a subtraction from the number of credits stored in the RAM 43. Moreover, when the number of betted coins exceeds an upper limit value for the number of coins that can be betted in one game (50 coins in the present embodiment), the main CPU 41 advances the processing to step S13 without performing the processing of making a subtraction from the number of credits stored in the RAM 43.

Next, in step S13, the main CPU 41 determines whether or not a spin button 23 has been turned on. In this processing, the main CPU 41 determines whether or not it has received an input signal outputted from the start switch 23S when the spin button 23 is pressed down.

When determining that the spin button 23 has not been turned on, the main CPU 41 returns the processing to step S11. It is to be noted that, when the spin button 23 has not been turned on (e.g. when a command to end of the game is inputted without turning-on of the spin button 23), the main CPU 41 cancels the subtraction result in step S12.

On the other hand, when determining in step S13 that the spin button 23 has been turned on, the main CPU 41 shifts the processing to step S14.

Next, the main CPU 41 performs symbol determination processing (step S14). In this symbol determination processing, the main CPU 41 executes a random number generation program included in the game program stored in the RAM 43 and selects numeric values from numeric values falling in the numeric range of 0 to 255, so as to determine symbols to be rearranged in the symbol display region 1.

Next, the main CPU 41 performs scroll-display control processing (step S15). This is processing of stopping scroll-display of the respective display blocks 28 such that the symbols determined in step S14 are rearranged, after start of scroll-display of symbols.

Next, the main CPU 41 determines whether or not a bonus game trigger has been established, namely whether or not three or more "BONUS" symbols have been rearranged in the symbol display region 1 (step S16).

When determining that the bonus game trigger has been established, the main CPU 41 reads a program for performing a bonus game from the RAM 43, to execute bonus game processing (step S17). The bonus game processing is detailed later using FIG. 9A and FIG. 9B.

When determining in step S16 that the bonus game trigger has not been established, the main CPU 41 determines whether or not a prize has been established (step S18). When determining that a prize has been established, the main CPU 41 pays out coins in accordance with the number of inserted coins and the prize (step S19).

When coins are to be accumulated, the main CPU 41 performs processing of making an addition to the number of credits stored in the RAM 43. On the other hand, when coins are to be paid out, the main CPU 41 transmits a control signal to the hopper 66, to pay out coins in a prescribed number.

When executing the processing of step S17 or S19, or when determining in step S18 that any prize has not been established (when determining that the game is lost), the main CPU 41 completes the present subroutine.

Figure 6:
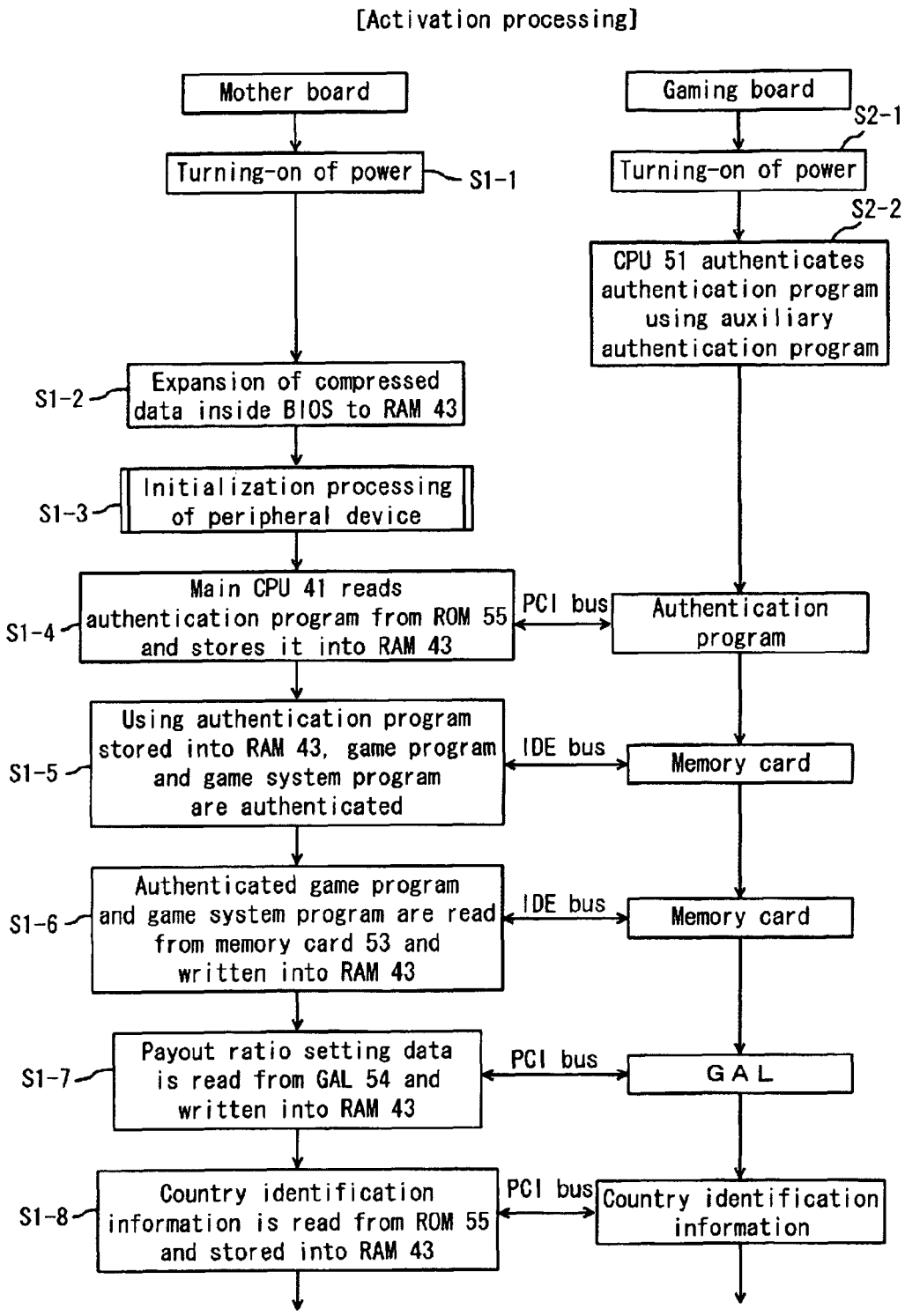
FIG. 6 is a flowchart showing a procedure of activation processing executed by a mother board and a gaming board.

FIG. 6 is a flowchart showing a procedure of activation processing.

This activation processing is the processing conducted by the mother board 40 and the gaming board 50. It should be noted that the memory card 53 is inserted into the card slot 53S in the gaming board 50, and the GAL 54 is mounted onto the IC socket 54S.

First, when a power switch is turned on (power is turned on) in the power supply unit 45, the mother board 40 and the gaming board 50 are activated (steps S1-1, S2-1). Inactivation of the mother board 40 and the gaming board 50, different processing is individually executed in parallel. Namely, in the gaming board 50, the CPU 51 reads the auxiliary authentication program stored in the boot ROM 52, and conducts auxiliary authentication according to the read auxiliary authentication program, to previously check and prove that the authentication program is not falsified before loading the program to the mother board 40 (step S2-2). Meanwhile, in the mother board 40, the main CPU 41 executes the BIOS stored in the ROM 42, and expands compressed data which is incorporated in the BIOS into the RAM 43 (step S1-2). The main CPU 41 then executes the BIOS expanded into the RAM 43 to diagnose and initialize a variety of peripheral devices (step S1-3). The processing of step S1-3 will be specifically described later with reference to FIG. 7.

Since the ROM 55 of the gaming board 50 is connected to the main CPU 41 via the PCI bus, the main CPU 41 reads the authentication program stored in the ROM 55, and stores the read authentication program into the RAM 43 (step S1-4). At this time, according to the standard BIOS function of BIOS, the main CPU 41 takes a checksum by ADDSUM system (normal checking system) and stores the authentication program into the RAM 43, while conducting processing for confirming whether or not the storage is certainly conducted.

Next, after confirming what is connected to the IDE bus, the main CPU 41 accesses, via the IDE bus, the memory card 53 inserted in the card slot 53S, to read a game program and a game system program from the memory card 53. In this case, the main CPU 41 reads data constituting the game program and the game system program by 4 bytes at a time. Subsequently, the main CPU 41 conducts authentication to check and prove that the read game program and game system program have not been falsified, by following the authentication program stored in the RAM 43 (step S1-5). When this authentication processing is normally completed, the main CPU 41 writes and stores the game program and the game system program, which have been the authentication targets (which have been authenticated), into the RAM 43 (step S1-6). Next, the main CPU 41 accesses via the PCI bus the GAL 54 mounted on the IC socket 54S, reads payout ratio setting data from the GAL 54, and writes and stores the data into the RAM (step S1-7). Subsequently, the main CPU 41 conducts processing for reading country identification information stored in the ROM 55 of the gaming board 50 via the PCI bus, and stores the read country identification information into the RAM 43 (step S1-8).

After conducting the above-mentioned processing, the main CPU 41 sequentially reads and executes the game program and the game system program, thereby proceeds with the game.

Figure 7:
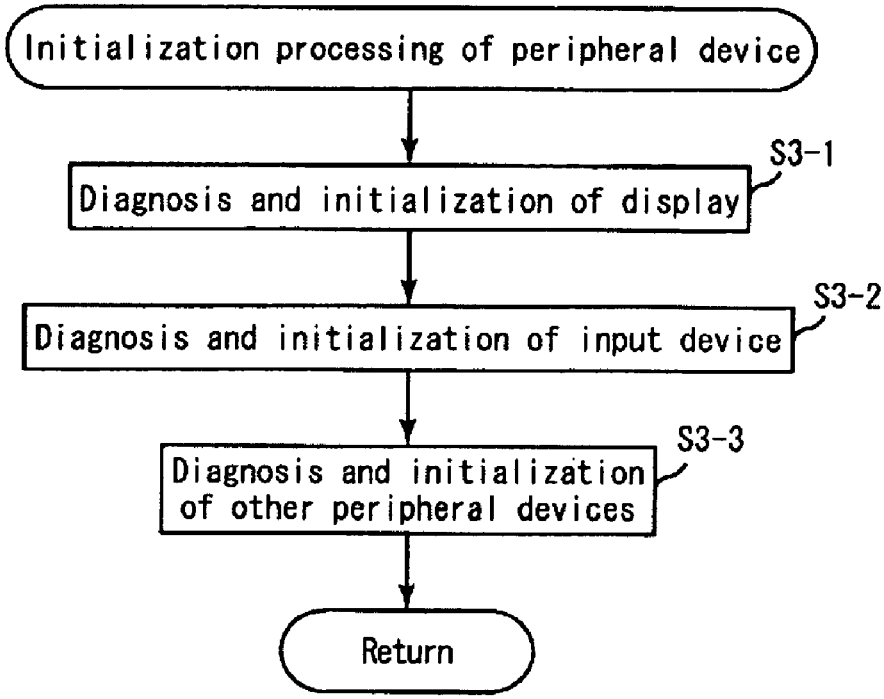
FIG. 7 is a flowchart showing a procedure of initialization processing of peripheral devices.

FIG. 7 is a flowchart showing a procedure of initialization processing of peripheral devices.

First, the main CPU 41 diagnoses and initializes the display (step S3-1). In this processing, the main CPU 41 transmits a request signal to the graphic board 68. Then, the main CPU 41 determines whether or not it has received a predetermined response signal and conducts clearance of a predetermined storage area, and the like.

Next, the main CPU 41 diagnoses and initializes various types of input devices (step S3-2). In this processing, the main CPU 41 transmits request signals to the input devices such as the start switch 23S, the change switch 24S, the CASHOUT switch 25S, the 1-BET switch 26S, the maximum BET switch 27S, and the touch panel 69, and then determines whether or not it has received predetermined response signals.

Subsequently, the main CPU 41 diagnoses and initializes other peripheral devices connected to the main CPU 41 (step S3-3). Then the present subroutine is completed.

In the present embodiment, a case has been described where the slot machine 10 is a standalone type. However, in the present invention, a plurality of slot machines may be connected to a central controller through the network, and the plurality of slot machines may be controlled by the central controller.

Figure 8:
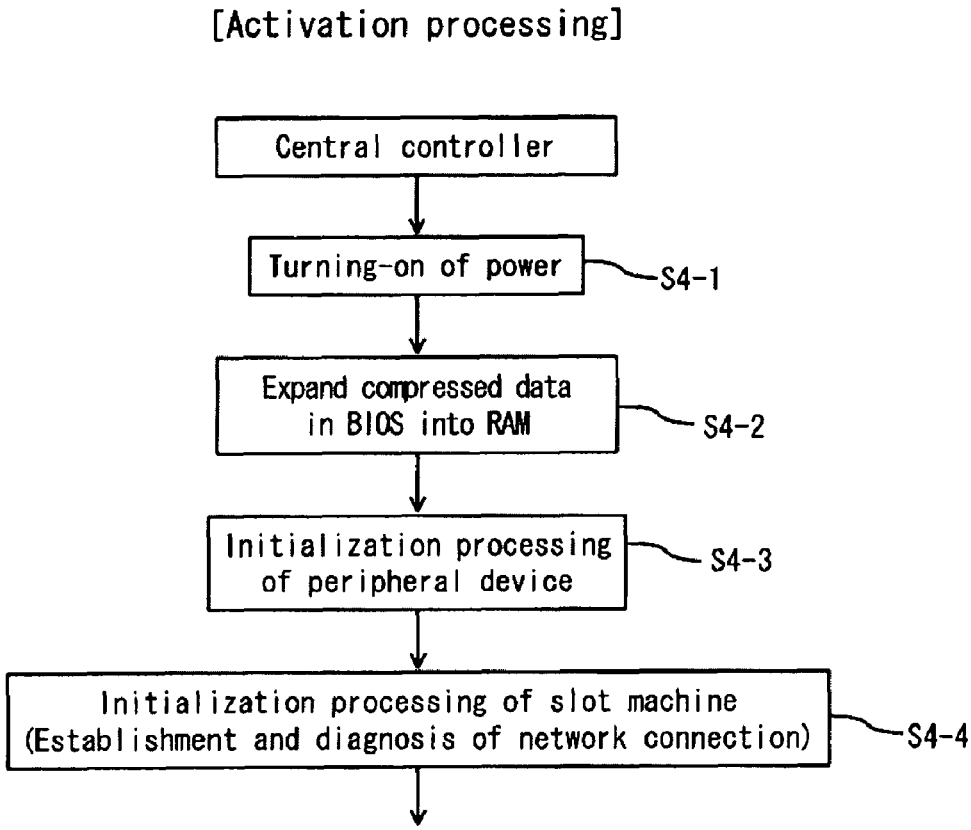
FIG. 8 is a flowchart showing a subroutine of activation processing executed by a central controller.

FIG. 8 is a flowchart showing a subroutine of activation processing executed by the central controller.

First, when the power switch is turned on (the power is turned on) in the power supply unit, a mother board is activated (step S4-1).

In the mother board, the CPU executes a BIOS stored in the ROM so as to expand compressed data incorporated in the BIOS into the RAM (step S4-2). Then, the CPU executes the BIOS expanded into the RAM, and then, diagnoses and initializes various types of peripheral devices such as the display (step S4-3).

Next, the CPU executes initialization processing of each slot machine (step S4-4). In this processing, the CPU establishes a network connection between the central controller and each slot machine, and diagnoses if the network functions properly.

After the above-described processing, the CPU controls progress of the game executed in the plurality of the slot machines by reading and executing a game control program.

Figure 9A:
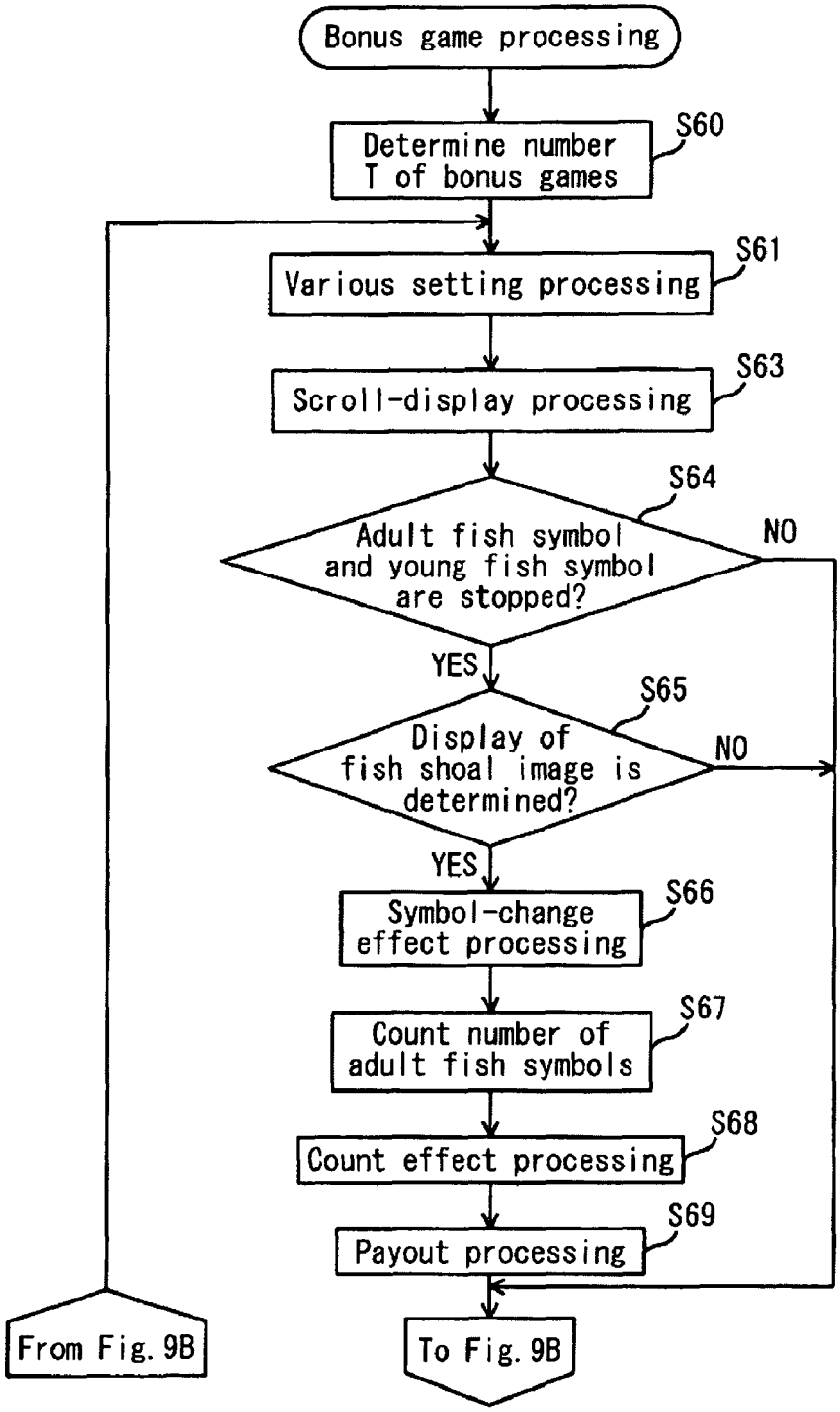
FIG. 9A is a flowchart showing a subroutine of bonus game processing.
Figure 9B:
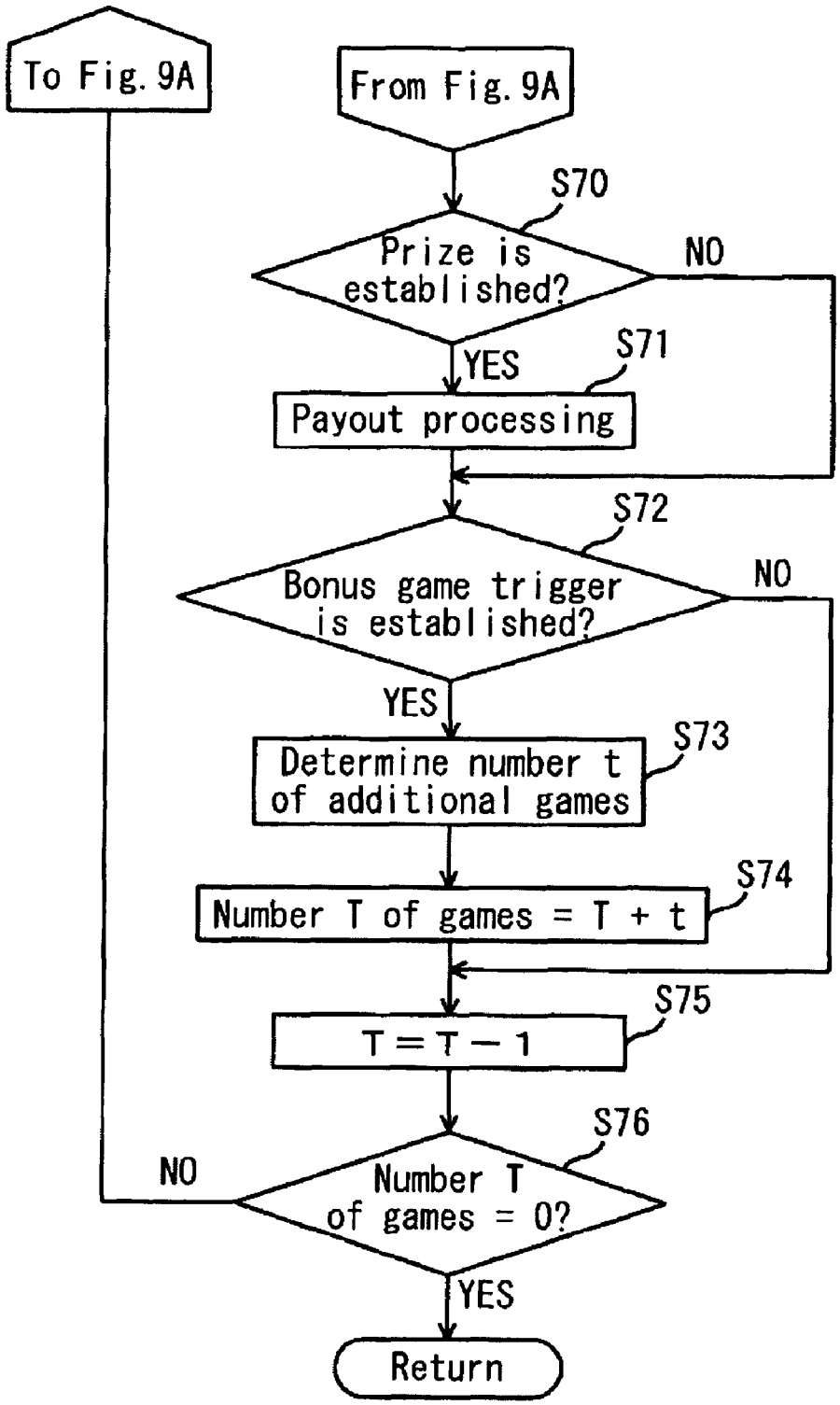
FIG. 9B is a flowchart showing a subroutine of the bonus game processing.

FIG. 9A and FIG. 9B are flowcharts showing a subroutine of the bonus game processing. The bonus game processing is processing called and executed in step S17 of the subroutine shown in FIG. 5.

First, the main CPU 41 determines the number of bonus games from 10 to 25 games, based on a random number value obtained by executing a random number generation program included in the symbol determination program stored in the RAM 43 (step S60). The main CPU 41 stores the determined number of games of the bonus game into the RAM 43 as data.

Next, the main CPU 41 performs a variety of setting processing (step S61). In step S61, the main CPU 41 determines symbols to be rearranged using random numbers, and also determines whether or not to display a fish shoal image indicating a change from young fish into adult fish.

Subsequently, the main CPU 41 performs scroll-display control processing (step S63).

Next, the main CPU 41 determines whether or not both the adult fish symbol 101 and the young fish symbol 102 are rearranged in the symbol display region 1 (step S64). When determining that not both of the adult fish symbol 101 and the young fish symbol 102 are rearranged, the main CPU 41 shifts the processing to step S70 of FIG. 9B.

On the other hand, when determining that both the adult fish symbol 101 and the young fish symbol 102 are rearranged, the main CPU 41 determines whether or not it has been determined in step S61 to display the fish shoal image (step S65). When determining that it has not been determined to display the fish shoal image, the main CPU 41 shifts the processing to step S70 of FIG. 9B.

On the other hand, when determining that it has been determined to display the fish shoal image, the main CPU 41 executes symbol-change effect processing (step S66).

Specifically, the main CPU 41 displays the fish shoal image 103 so as to move across the symbol display region 1 (see FIG. 1B), and then executes a rotating effect by means of the rotational display block image 91 in the display block 28 where the young fish symbol 102 has been displayed (see FIG. 1C), to execute the effect of changing the young fish symbol 102 in the display block 28 into the adult fish symbol 101 (see FIG. 1D).

Next, the main CPU 41 performs processing of counting the number of adult fish symbols 101 arranged in the symbol display region 1 (step S67).

Next, the main CPU 41 executes count effect processing (step S68). Specifically, the main CPU 41 additionally displays, one by one, the symbol count images 104 provided with sequential numbers starting from 1 in the respective display blocks 28 where the adult fish symbols 101 are displayed (see FIG. 1E).

Next, the main CPU 41 pays out coins based on the number of adult fish symbols 101 counted in step S67 (step S69).

Next, the main CPU 41 determines whether or not a prize has been established (step S70 of FIG. 9B). When determining that the prize has been established, the main CPU 41 pays out coins in accordance with the number of inserted coins and the prize (step S71).

After executing the processing of step S71, or when determining in step S70 that the prize has not been established, the main CPU 41 determines whether or not the bonus game trigger has been established (step S72). When determining that the bonus game trigger has been established, the main CPU 41 newly determines the number t of bonus game repetition times (step S73), and then adds the determined number t of bonus game repetition times to the number T of games of the current bonus game (step S74). Therefore, when the bonus game is won during a bonus game, the remaining number of bonus games increases. More specifically, for example, in a case where the game is first shifted to 20 bonus games, when 17 bonus games are won in the 12th bonus game, 25 (=20−12+17) bonus games will be conducted thereafter.

When the bonus game trigger has not been established in step S72, or when executing the processing of step S74, the main CPU 41 reads the number T of games of the bonus game stored in the RAM 43, and subtracts 1 from the value of the read number T of games. The main CPU 41 then stores again into the RAM 43 the number T of games after subtraction (step S75).

Next, the main CPU 41 determines whether or not the number of executed bonus games has reached the number of times determined in step S60 (step S76). Specifically, the main CPU 41 determines whether or not the number T of games stored in the RAM 43 has become 0. When the number T of games is not 0, i.e. when determining that the number of executed bonus games has not reached the number of times determined in step S60, the main CPU 41 returns the processing to step S61, and repeats the foregoing processing. On the other hand, when the number T of games is 0, i.e. when determining that the number of executed bonus games has reached the number of times determined in step S60, the main CPU 41 completes the present subroutine.

As described above, the slot machine 10 according to the present embodiment comprises: the lower image display panel 16 (display) capable of displaying an image; the RAM 43 (memory) which stores image data respectively showing the adult fish symbol 101, the young fish symbol 102, and other symbols different from both the adult fish symbol 101 and the young fish symbol 102; and the mother board 40 (controller). The mother board 40 is programmed so as to execute the processing of (a) displaying to the lower image display panel 16 the rectangular symbol display region 1 in which the plurality of display blocks 28 are arranged in matrix form, (b) rearranging a symbol, shown by image data stored in the RAM 43, in each display block 28 of the symbol display region 1, (c) determining whether or not to display the fish shoal image 103 relative to the symbol, to the lower image display panel 16, (d) scroll-displaying the fish shoal image 103 to the lower image display panel 16 in a direction from one side of the symbol display region 1 toward the opposite side, performing an effect of rotating an image displayed in each display block 28 having the young fish symbol 102 rearranged therein around an imaginary central line of each display block 28 as a rotational axis in a direction so as to turn a display screen of the lower image display panel 16 over to the other side, and changing the young fish symbol 102 rearranged in the each display block 28 into the adult fish symbol 101, the above-mentioned processing being conducted when the adult fish symbol 101 and the young fish symbol 102 have been rearranged in the symbol display region 1 in the processing (b) and also when it has been determined in the processing (c) to display the fish shoal image 103, and (e) offering a payout in accordance with the number of adult fish symbols arranged in the symbol display region 1 as a result of the processing (d).

Namely, when the fish shoal image 103 is displayed in a case where the adult fish symbol 101 and the young fish symbol 102 have been rearranged, the image in the display block 28 having the young fish symbol 102 rearranged therein is rotated and the young fish symbol 102 is changed into the adult fish symbol 101. Therefore, performing the new effect using symbols can prevent the effect according to rearrangement of symbols from becoming monotonous.

Further, since the young fish symbol 102 is changed into the adult fish symbol 101 when the fish shoal image 103 is displayed, it is possible to make the player have an expectation for display of the fish shoal image 103.

Moreover, since the number of adult fish symbols 101 relative to offering of a payout changes based on whether or not the young fish symbol 102 is simultaneously rearranged and whether or not the fish shoal image 103 is displayed, variations can be added to the game, and hence it is possible to prevent the player from becoming bored and to have the player enjoy the game.

Further, according to the slot machine 10, since the display blocks 28 each having the adult fish symbol 101 displayed therein are additionally provided with images including sequential numbers (symbol count images 104), the player can promptly and accurately grasp how many adult fish symbols 101 are displayed.

Further, since the sequential numbers are provided in a state where the adult fish symbols 101 arranged in the display blocks 28 are kept as they are (i.e., the sequential numbers are additionally provided), the number of adult fish symbols 101 can be counted without impairing the effect advantage by the symbols.

In the present embodiment, the configuration is adopted in which the effect of rotating an image of the display block 28 having the young fish symbol 102 displayed therein is performed when the adult fish symbol 101 (first specific symbol) and the young fish symbol 102 (second specific symbol) are displayed in the symbol display region 1 and also when the fish shoal image 103 (specific character image) is displayed. However, in the present invention, the effect, which is to be performed in a case where the first specific symbol and the second specific symbol are displayed and the specific character image is displayed, is not limited to this example. For example, the effect of rapidly changing a background color of the display block having the second specific symbol displayed therein may be performed.

Although the present invention has been described with reference to embodiments thereof, these embodiments merely illustrate specific examples, not restrict the present invention. The specific structures of respective means and the like can be designed and changed as required. Furthermore, there have been merely described most preferable effects of the present invention, as the effects of the present invention, in the embodiments of the present invention. The effects of the present invention are not limited to those described in the embodiments of the present invention.

Further, in the aforementioned detailed description, characteristic portions have been mainly described, for ease of understanding the present invention. The present invention is not limited to the embodiments described in the aforementioned detailed description, but can be also applied to other embodiments over a wider range of applications. Further, the terms and phrases used in the present specification have been used for clearly describing the present invention, not for limiting the interpretation of the present invention. Further, those skilled in the art will easily conceive other structures, systems, methods and the like which are included in the concept of the present invention, from the concept of the present invention described in the present specification. Accordingly, the description of the claims is intended to include equivalent structures that fall within the technical scope of the invention. Further, the abstract aims at enabling engineers and the like who belong to the present technical field but are not familiar with the patent office and public institutions, the patent, law terms and technical terms to immediately understand the technical content and the essence of the present application through brief studies. Accordingly, the abstract is not intended to restrict the scope of the invention which should be evaluated from the description of the claims. It is desirable that literatures and the like which have been already disclosed are sufficiently studied and understood, in order to sufficiently understand the objects of the present invention and the specific effects of the present invention.

In the aforementioned detailed description, there has been described processing to be executed by computers. The aforementioned description and expressions have been described for the sake of enabling those skilled in the art to understand the present invention most effectively. In the present specification, each step for deriving a single result should be understood to be self-consistent processing. Further, each step includes transmission, reception, recording and the like of electric or magnetic signals. Although, in the processing at each step, such signals have been expressed as bits, values, symbols, characters, terms, numerical characters and the like, it should be noticed that they have been merely used for convenience of description. Further, although the processing at each step was described using expressions common to human behaviors in some cases, the processes described in the present specification are to be executed by various types of devices, in principle. Further, other structures required for conducting each step will be apparent from the aforementioned description.

What is claimed as new and desired to be secured by Letters Patent of the United States is:

1. A gaming machine comprising:

a display capable of displaying an image;

a memory which stores image data respectively showing a first specific symbol, a second specific symbol different from said first specific symbol, and other symbols different from both said first specific symbol and said second specific symbol; and a controller, said controller programmed so as to execute the processing of (a) displaying to said display a rectangular symbol display region in which a plurality of display blocks are arranged in a longitudinal direction and a traverse direction to form a matrix, (b) rearranging a symbol, shown by image data stored in said memory, in each display block of said symbol display region, by scroll-displaying groups of the display blocks in the longitudinal direction on a group-by-group basis, each of which groups formed by an array of the display blocks in the longitudinal direction, (c) determining whether or not to display a specific character image relative to said symbol, to said display, (d) scroll-displaying said specific character image to said display in the transverse direction, performing an effect of rotating an image displayed in each display block having said second specific symbol rearranged therein around an imaginary central line of each display block as a rotational axis, and changing said second specific symbol rearranged in the each display block into said first specific symbol, the above-mentioned steps of scroll-displaying said specific character image, performing an effect, and changing said second specific symbol being conducted when said first specific symbol and said second specific symbol have been rearranged in any of the groups of the display blocks in said processing (b) and also when it has been determined in said processing (c) to display said specific character image, and (e) offering an award in accordance with the number of first specific symbols arranged in said symbol display region as a result of said processing (d).

2. A gaming machine comprising:

a display capable of displaying an image;

a memory which stores image data respectively showing a first specific symbol, a second specific symbol different from said first specific symbol, and other symbols different from both said first specific symbol and said second specific symbol;

and a controller, said controller programmed so as to execute the processing of (a) displaying to said display a symbol display region in which a plurality of display blocks are arranged in a longitudinal direction and a transverse direction to form a matrix, (b) rearranging a symbol, shown by image data stored in said memory, in each display block of said symbol display region, by scroll-displaying groups of the display blocks in the longitudinal direction on a group-by-group basis, each of which groups formed by an array of the display blocks in the longitudinal direction, (c) determining whether or not to display to said display a predictive image indicating a change from said second specific symbol into said first specific symbol, (d) changing a rearranged second specific symbol into said first specific symbol after displaying said predictive image to said display, when said first specific symbol and said second specific symbol have been rearranged in any of the groups of the display blocks in said processing (b) and also when it has been determined in said processing (c) to display said predictive image, and (e) offering an award in accordance with the number of first specific symbols arranged in said symbol display region as a result of said processing (d).

3. A control method of a gaining machine, the method comprising the steps of:

(a) displaying a symbol display region in which a plurality of display blocks are arranged in a longitudinal direction and a transverse direction to form a matrix, to a display capable of displaying an image, (b) rearranging in each display block of said symbol display region a symbol that is selected from a first specific symbol, a second specific symbol different from said first specific symbol, and other symbols different from both said first specific symbol and said second specific symbol, the rearrangement occurring by scroll-displaying groups of the display blocks in the longitudinal direction on a group-by-group basis, each of which groups formed by an array of the display blocks in the longitudinal direction, (c) determining whether or not to display to said display a predictive image indicating a change from said second specific symbol into said first specific symbol, (d) changing a rearranged second specific symbol into said first specific symbol after displaying said predictive image to said display, when said first specific symbol and said second specific symbol have been rearranged in in any of the groups of the display blocks in said step (b) and also when it has been determined in said step (c) to display said predictive image, and (e) offering an award in accordance with the number of first specific symbols arranged in said symbol display region as a result of said step (d).

4. The gaming machine according to claim 1, wherein said controller is further programmed so as to execute the processing of (f) additionally displaying an image showing a sequential number in each display block where said first specific symbol has been arranged as a result of said processing (d).

5. The gaming machine according to claim 2, wherein said controller is further programmed so as to execute the processing of (f) additionally displaying an image showing a sequential number in each display block where said first specific symbol has been arranged as a result of said processing (d).

6. The control method of a gaming machine according to claim 3, the method further including the step of (f) additionally displaying an image showing a sequential number in each display block where said first specific symbol has been arranged as a result of said step (d).

* * * * *